US008049434B2

(12) United States Patent
Crouse et al.

(10) Patent No.: US 8,049,434 B2
(45) Date of Patent: Nov. 1, 2011

(54) LIGHTING COMMISSIONING DEVICE AND METHOD

(75) Inventors: Kent E. Crouse, Carpentersville, IL (US); Ling Wang, Chicago, IL (US); William L. Keith, Lake in the Hills, IL (US); James Cai, Burr Ridge, IL (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 862 days.

(21) Appl. No.: 12/066,142

(22) PCT Filed: Sep. 6, 2006

(86) PCT No.: PCT/IB2006/053135

§ 371 (c)(1), (2), (4) Date: Mar. 7, 2008

(87) PCT Pub. No.: WO2007/029186

PCT Pub. Date: Mar. 15, 2007

(65) Prior Publication Data

US 2008/0218087 A1 Sep. 11, 2008

Related U.S. Application Data

(60) Provisional application No. 60/714,691, filed on Sep. 7, 2005.

(51) Int. Cl.
*H05B 37/00* (2006.01)

(52) U.S. Cl. ..... 315/291; 315/149; 315/294; 315/295

(58) Field of Classification Search ..... 315/291, 315/149, 156, 157, 158, 159, 293, 294, 295, 315/307

See application file for complete search history.

(56) References Cited

U.S. PATENT DOCUMENTS

| | | | |
|---|---|---|---|
| 4,638,298 | A | 1/1987 | Spiro |
| 5,637,964 | A | 6/1997 | Hakkarainen et al. |
| 5,838,116 | A | 11/1998 | Katyl et al. |
| 5,945,993 | A | 8/1999 | Fleischmann |
| 6,333,605 | B1 | 12/2001 | Grouev et al. |
| 6,794,831 | B2 | 9/2004 | Leeb et al. |

(Continued)

FOREIGN PATENT DOCUMENTS

JP 09283282 A 10/1997

(Continued)

OTHER PUBLICATIONS

"Wireless industrial networks—untether monitoring and control" Frenzel, Le. Source: Electronic Design, v 52, n 21, Sep. 20, 2004, p. 46-8, 50, 52, 54, 56, 58.

(Continued)

*Primary Examiner* — David Hung Vu

(74) *Attorney, Agent, or Firm* — John F. Salazar; Mark L Beloborodov

(57) ABSTRACT

A lighting commissioning device and method including a lighting commissioning device for commissioning of a lighting device in a lighting system, the lighting commissioning device including an indication detector 142 responsive to indication from the lighting device and generating a lighting device indication signal 148, a change detector 144 responsive to the lighting device indication signal 148 and generating an indication detected signal 150, and a control unit 146 receiving the indication detected signal 150 and being operably connected to the lighting system.

10 Claims, 6 Drawing Sheets

U.S. PATENT DOCUMENTS

| | | | | |
|---|---|---|---|---|
| 7,126,291 | B2 * | 10/2006 | Kruse et al. | 315/316 |
| 2002/0043938 | A1 | 4/2002 | Lys | |
| 2003/0020595 | A1 | 1/2003 | Wacyk | |
| 2004/0233855 | A1 | 11/2004 | Gutierrez et al. | |

FOREIGN PATENT DOCUMENTS

| | | | |
|---|---|---|---|
| WO | 2003094564 | A1 | 11/2003 |
| WO | 2004023224 | A2 | 3/2004 |
| WO | 2004109974 | A1 | 12/2004 |
| WO | 2005004420 | A2 | 1/2005 |

OTHER PUBLICATIONS

Contenti C. Ed—Institute of electrical and electronics engineers: "Digitally Addressable Dali Dimming Ballast" APEC 2002. 17th Annual IEEE Applied Power Electronics Conference and Exposition. Dallas, TX, Mar. 10-14, 2002, Annual applied power electronics conference, New York, NY: IEEE, US, vol. vol. 2 of 2, Conf. 17, Mar. 10, 2002 , pp. 936-942, XP010583030. ISBN 0-7803-7404-5 the whole document.

* cited by examiner

LIGHTING COMMISSIONING DEVICE AND METHOD

CROSS REFERENCE TO RELATED APPLICATION

This application claims the benefit of U.S. provisional application Ser. No. 60/714,691, filed Sep. 7, 2005, the entire subject matter of which is hereby incorporated by reference.

This invention relates generally to lighting systems, and more specifically to devices and methods for commissioning lighting systems.

Electronic ballasts have been developed to control current to lamps, such as fluorescent lamps. The electronic ballasts, which have wired or wireless communication interfaces built-in or connected, communicate with control devices, such as remote controls, wall dimmers, occupancy sensors, and light sensors, to set the lighting for particular activities, time of day, and use. The electronic ballasts provide flexible, energy efficient lighting.

One particular challenge is to commission a lighting system including multiple lighting devices, such as ballasts and control devices. Commissioning involves setting up newly installed light fixtures to communicate with the proper control devices under desired device control parameters. Modern offices and commercial buildings include hundreds of lighting fixtures that must be in communication with one or more control device. Presently, lighting fixtures are commissioned one at a time. An installer issues a command, e.g., a command to flash the light, to one of the installed lighting fixtures by identification (ID) number once communication within the lighting system is established. The ID number is selected from the list of ID numbers assigned to the lighting fixtures during manufacture.

The installer wanders the floor or building looking for the lighting fixture which responded to the command, e.g., the lighting fixture which is flashing. The installer then records the location and ID number of the lighting fixture on a map. This time consuming process is repeated for each lighting fixture until all the installed lighting fixtures have a recorded location and ID number.

The commissioning continues with linking the lighting fixtures to control devices and establishing control parameters. Each lighting fixture is linked to one or more control device. The control parameters can include lighting group assignments, remote control numbers, dim levels, dim rate, light scenes, and the like. The installer individually stores the linking and control parameters for each lighting fixture, requiring a great deal of time, effort, and expense.

It would be desirable to have a lighting commissioning system and method that overcomes the above disadvantages.

One aspect of the present invention provides a lighting commissioning device for commissioning of a lighting device in a lighting system, the lighting commissioning device including an indication detector responsive to indication from the lighting device and generating a lighting device indication signal, a change detector responsive to the lighting device indication signal and generating an indication detected signal, and a control unit receiving the indication detected signal and being operably connected to the lighting system.

Another aspect of the present invention provides a method of lighting commissioning including establishing communications between a first lighting device and a second lighting device, the first lighting device having a first identification number and the second lighting device having a second identification number, determining the first lighting device location from the first identification number, storing device control parameters for the first lighting device at the first lighting device, determining the second lighting device location from the second identification number, transmitting the device control parameters from the first lighting device to the second lighting device, and storing the device control parameters at the second lighting device.

Another aspect of the present invention provides a system of lighting commissioning including means for establishing communications between a first lighting device and a second lighting device, the first lighting device having a first identification number and the second lighting device having a second identification number, means for determining the first lighting device location from the first identification number, means for storing device control parameters for the first lighting device at the first lighting device, means for determining the second lighting device location from the second identification number, means for transmitting the device control parameters from the first lighting device to the second lighting device, and means for storing the device control parameters at the second lighting device.

Another aspect of the present invention provides a method of lighting commissioning including establishing communications between a plurality of lighting devices including a first lighting device having a first identification number, determining a list of identification numbers for the plurality of lighting devices, pointing an indication detector towards the first lighting device, sequentially transmitting an indicator command for each identification number on the list of identification numbers, and noting the location for the first lighting device when the indication detector detects an indication for the first lighting device.

Another aspect of the present invention provides a system of lighting commissioning including means for establishing communications between a plurality of lighting devices including a first lighting device having a first identification number, means for determining a list of identification numbers for the plurality of lighting devices, means for pointing an indication detector towards the first lighting device, means for sequentially transmitting an indicator command for each identification number on the list of identification numbers, and means for noting the location for the first lighting device when the indication detector detects an indication for the first lighting device.

Another aspect of the present invention provides a method of lighting commissioning including establishing communications between a plurality of lighting devices including a first lighting device having a first identification number, determining a list of identification numbers for the plurality of lighting devices, distributing a plurality of lighting commissioning devices to desired locations, sequentially transmitting an indicator command for each identification number on the list of identification numbers, detecting an indication for the first lighting device with at least one of the plurality of lighting commissioning devices, and correlating the indication for the first lighting device with transmission of the indicator command for the first lighting device to determine the first lighting device location from location of the at least one of the plurality of lighting commissioning devices.

Another aspect of the present invention provides a system of lighting commissioning including means for establishing communications between a plurality of lighting devices including a first lighting device having a first identification number, means for determining a list of identification numbers for the plurality of lighting devices, means for distributing a plurality of lighting commissioning devices to desired locations, means for sequentially transmitting an indicator command for each identification number on the list of identification numbers, means for detecting an indication for the first lighting device with at least one of the plurality of lighting commissioning devices, and means for correlating the indication for the first lighting device with transmission of the indicator command for the first lighting device to determine the first lighting device location from location of the at least one of the plurality of lighting commissioning devices.

The foregoing and other features and advantages of the invention will become further apparent from the following detailed description of the presently preferred embodiment, read in conjunction with the accompanying drawings. The detailed description and drawings are merely illustrative of the invention rather than limiting, the scope of the invention being defined by the appended claims and equivalents thereof.

Figure 1:
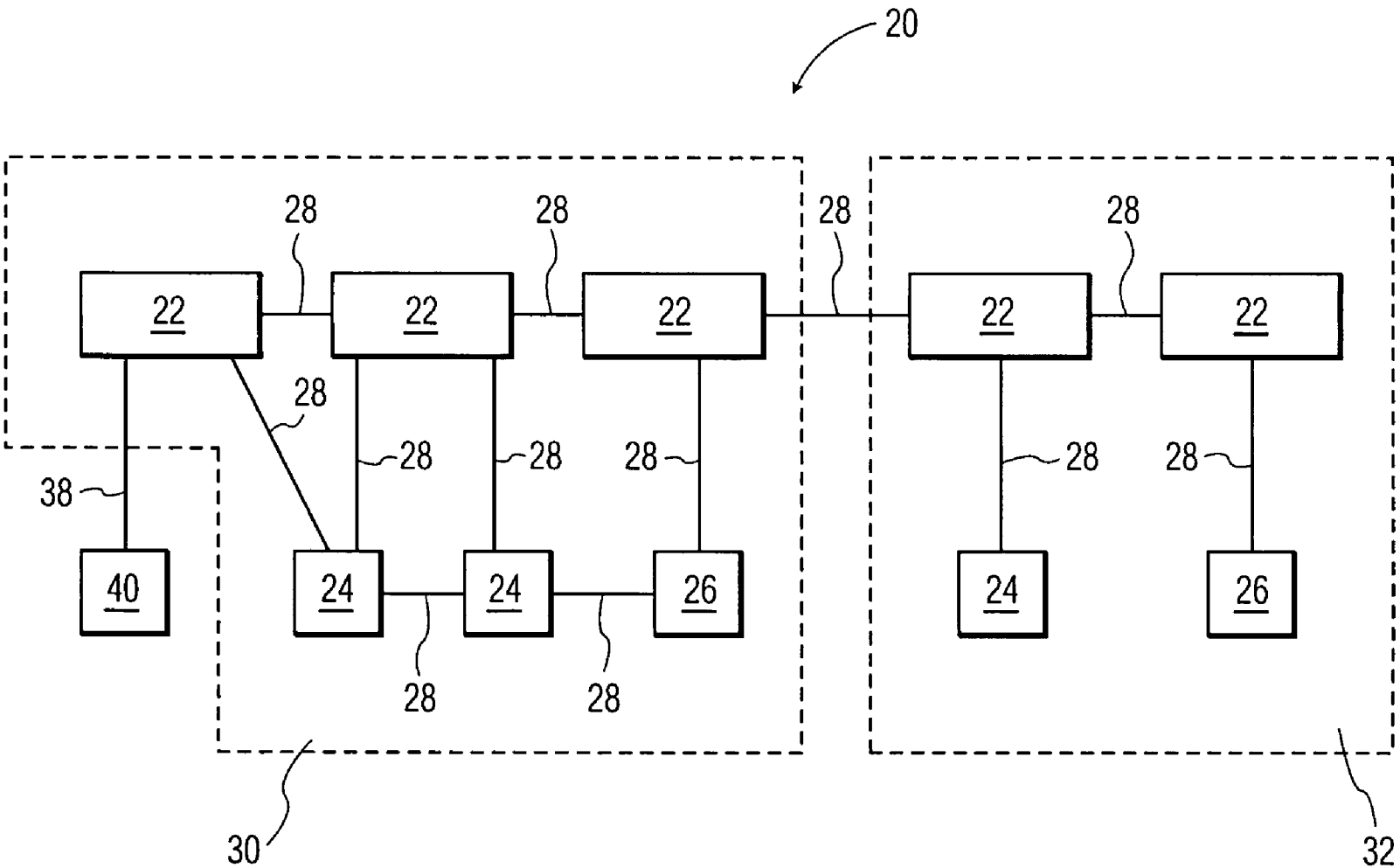
FIG. 1 is a block diagram of a lighting system for lighting commissioning in accordance with the present invention.

FIG. 1 is a block diagram of a lighting system for lighting commissioning in accordance with the present invention. The lighting system 20 can be any lighting system including lighting devices which are in communication with each other in a network. The lighting devices can include light fixtures 22; remote controls 24, including local remote controls, wall switches, and gateways to other networks and/or automation systems; and area sensors 26, such as lighting sensors or occupancy sensors. The lighting devices communicate over communication paths 28. A single lighting device can be connected to one or more lighting devices through the communication paths 28. In this example, the lighting devices are divided into a first group 30 and a second group 32. Such groups can correspond to different rooms within a building, different areas within a room, and/or different regions of outdoor lighting. A lighting commissioning device 40 can be used as a communication gateway to the lighting system 20 when commissioning the lighting system 20. In one embodiment, the lighting commissioning device 40 is a portable device, such as a laptop computer, a handheld personal digital assistant (PDA), a pocket personal computer (PC), a portable dedicated lighting commissioning device, or the like. Examples of portable dedicated lighting commissioning devices include a pointing lighting commissioning device and a distributable lighting commissioning device. In another embodiment, the lighting commissioning device 40 is a part of the lighting system 20, such as a lighting system control normally used to control the lighting system within a building. The lighting commissioning device 40 communicates with the lighting system 20 over wired or wireless commissioning communication path 38.

The communication paths 28 can be wired or wireless and employ particular communication protocols as desired. In one embodiment, the communications protocol is the Digital Addressable Lighting Interface (DALI) protocol set out in Annex E of the fluorescent ballast standard IEC 60929. In another embodiment, the communications protocol is the ZigBee protocol operating on top of the IEEE 802.15.4 wireless standard. In yet another embodiment, the communications protocol is the EmberNet protocol. Those skilled in the art will appreciate that any number of wired and wireless protocols, both open and proprietary, can be used in control of the lighting system 20. The topology of the lighting system 20 can be any topology desired, such as a serial network, mesh network, star network, cluster tree network, hybrid network, or the like.

Figure 2:
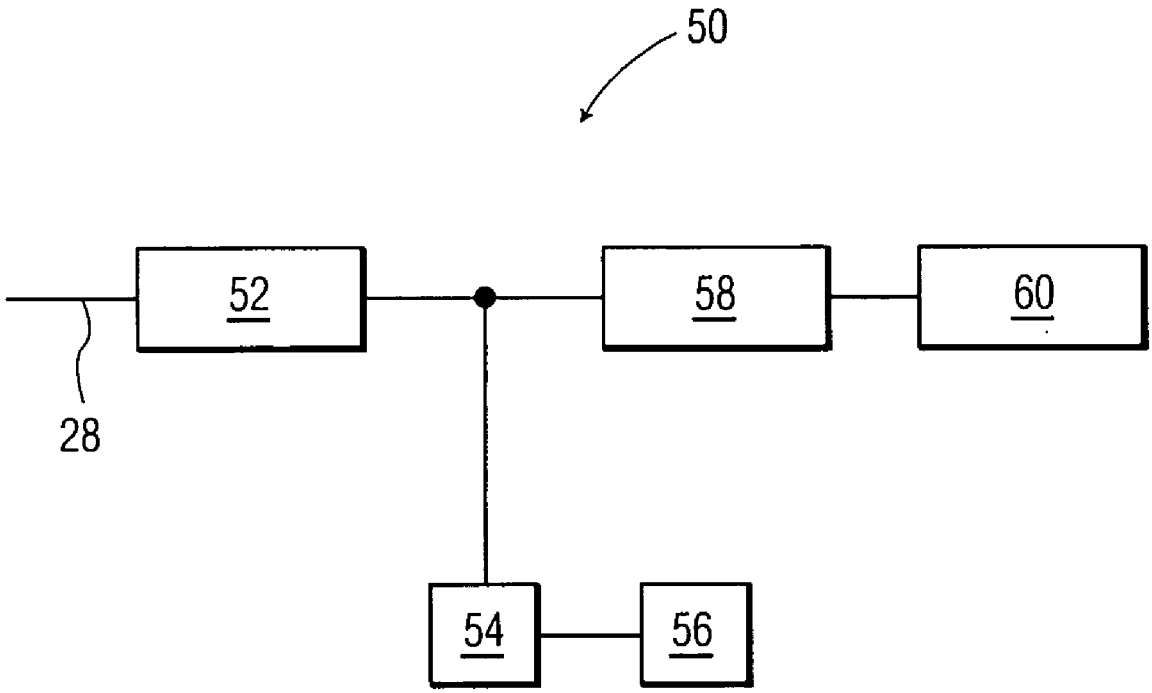
FIG. 2 is a block diagram of a lighting device for lighting commissioning in accordance with the present invention.

FIG. 2 is a block diagram of a lighting device for lighting commissioning in accordance with the present invention. The lighting device 50 includes a communications interface 52, microprocessor 54, memory 56, control interface 58, and device indicator 60. In one embodiment, the memory 56 is included in the microprocessor 54. The wired or wireless communications interface 52, such as a radio frequency transceiver, is operably connected to the communication path 28 to communicate with other lighting devices. The microprocessor 54 controls the lighting device 50 in response to signals from other lighting devices and instructions stored in the memory 56. The memory 56 can store data and instructions for the lighting device 50, including permanent and network identification numbers and device control parameters. The memory 56 can also store a cloning program that permits the network device 50 to transfer its device control parameters to other lighting devices. The control interface 58 communicates with the microprocessor 54 and the device indicator 60.

The device indicator 60 provides an installer discernable indication that the lighting device 50 has received an indicator command, such as a turn on/turn off or a dim up/dim down command for a lamp. The installer can detect the response of the lighting device 50 to an indicator command by use of the installer's senses (sight, sound) and/or by use of a lighting commissioning device that detects the response. Typically, the device indicator 60 is a normal part of the lighting device 50, such as a lamp or a liquid crystal display (LCD), but the device indicator 60 can be a dedicated part just for commissioning, such as a commissioning light emitting diode (LED) or commissioning noisemaker, commissioning radio frequency transmitter, or the like. In one embodiment, the lighting device 50 is a lighting fixture, the control interface 58 is a ballast, such as an electronic ballast, and the device indicator 60 is a ballast driven lamp, such as a fluorescent lamp. In another embodiment, the lighting device 50 is a lighting fixture, the control interface 58 is a lighting controller, such as a dimmer and/or switch, and the device indicator 60 is a directly driven lamp, such as an incandescent lamp or a light emitting diode (LED) lamp at visible or infrared frequencies. In another embodiment with the lighting device 50 is a remote control, the control interface 58 is a signal interface and the device indicator 60 is a human interface, such as a keyboard with display or liquid crystal display (LCD). In another embodiment, the lighting device 50 is an area sensor, the control interface 58 is a signal interface, and the device indicator 60 is a sensing element, such as a light sensor, an occupancy sensor, or the like.

Figure 3:
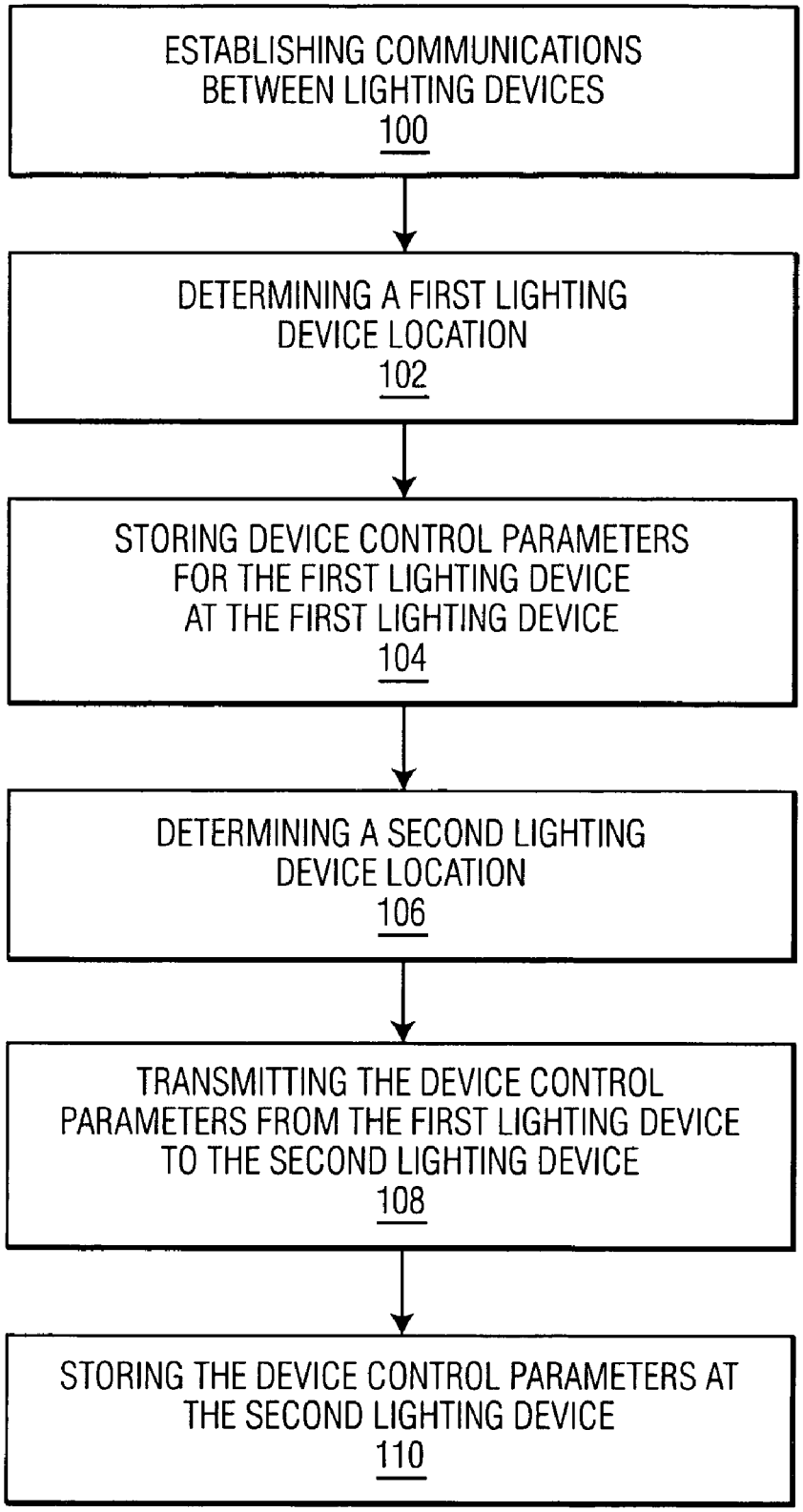
FIG. 3 is a flow chart of a method for lighting commissioning in accordance with the present invention.

FIG. 3 is a flow chart of a method for lighting commissioning in accordance with the present invention. The method includes establishing communications among lighting devices, which each have an identification number 100, determining the location of a first lighting device from the identification number for that lighting device 102, storing device control parameters for the first lighting device at the first lighting device 104, determining the second lighting device location from the identification number for the second lighting device 106, transmitting the device control parameters from the first lighting device to the second lighting device 108, and storing the device control parameters at the second lighting device 110. In one embodiment, the method can continue for additional lighting devices with the device control parameters being sent to a number of lighting devices from the first lighting device and the device control parameters being stored in the lighting devices. In another embodiment, the method can continue for additional lighting devices with the device control parameters being sent to one or more lighting devices from the second lighting device. In one embodiment, the device control parameters can propagate geometrically across the lighting devices in the lighting system with each lighting device providing the device control parameters to two or more other lighting devices.

Establishing communications among lighting devices, which each have an identification number 100, can be performed in any manner suitable for the particular lighting system. The lighting devices can be light fixtures, remote controls, area sensors, or the like. In one embodiment, the lighting devices automatically establish communications by handshaking between the lighting devices based on certain protocols. In another embodiment, the communications are established manually, such as by entering identification numbers and pressing buttons or switches s for the lighting devices in the lighting system. The identification numbers can be permanent identification numbers, network identification numbers, or the like. The permanent identification numbers, such as IEEE addresses, can be assigned to the lighting devices during manufacture or before installation. The permanent identification numbers are typically stored in memory in the lighting device. The network identification numbers are manually and/or automatically assigned to the lighting devices. In one embodiment, the lighting device that is responsible for establishing the network selects a random network identification number, broadcasts the selected random network identification number, and assigns the selected random network identification number as the unique identification for this new network when no other lighting device answers, indicating that the selected random network identification number is unused. Other lighting devices can then join the network by handshaking with one or more lighting devices that are already in the network. Each lighting device associated with the network is assigned a network identification number reflecting their association with the particular network.

Determining the location of a first lighting device from the identification number for that lighting device 102 includes transmitting an indicator command including the first identification number and detecting the response of the first lighting device to the indicator command. The indicator command and corresponding response can be any human or machine detectable response. In one embodiment, the indicator command directs the lighting device, such as a lighting fixture, to turn on and turn off, and the response is that the lighting device having the included identification number turns on and turns off. This can be visually observed by an installer and/or detected with a lighting commissioning device having a light sensor such as a photodetector. In another embodiment, the indicator command directs the lighting device, such as a lighting fixture, to dim up and dim down, and the response is that the lighting device having the included identification number dims up and dims down. This can be visually observed by an installer and/or detected with a lighting commissioning device having a light sensor such as a photodetector. In yet another embodiment, the indicator command directs the lighting device, such as a remote control or area sensor, to provide an indication, such as flashing an indicator light emitting diode (LED) or emitting an audible, ultrasonic, or radio frequency signal. The response is that the lighting device having the included identification number provides the indication, which can be observed by an installer and/or detected with a lighting commissioning device having an appropriate sensor. The first lighting device location can be manually entered on a map by the installer and/or automatically entered on a map by a lighting commissioning device.

Another embodiment of determining the location of a first lighting device from the identification number for that lighting device 102 includes determining the location with a portable lighting commissioning device having an indication detector pointed towards the first lighting device. A list of identification numbers for lighting devices in the lighting system is determined and the indication detector is pointed towards the first lighting device.

An indicator command for each identification number on the list of identification numbers is sequentially transmitted from the portable lighting commissioning device or another communication gateway to the lighting system. When the indication detector detects an indication for the first lighting device, the location for the first lighting device is noted. The indication can be detectable by the installer or can be so rapid or at a frequency to put the indication beyond human perception. In one embodiment, the determining the location can also include confirming the location for the first lighting device, such as by sending an additional indicator command for the identification number for which the indication was detected and again detecting the indication for the first lighting device. When no confirming indication is received, the location determination can be repeated for the list of identification numbers.

Another embodiment of determining the location of a first lighting device from the identification number for that lighting device 102 includes determining the location with portable lighting commissioning devices having indication detectors distributed at desired locations. A list of identification numbers for lighting devices in the lighting system is determined and a number of lighting commissioning devices are distributed to desired locations. An indicator command for each identification number on the list of identification numbers is sequentially transmitted from a communication gateway to the lighting system. An indication for the first lighting device is detected with at least one of the plurality of lighting commissioning devices. The indication for the first lighting device is correlated with transmission of the indicator command for the first lighting device to determine the first lighting device location from location of the at least one of the plurality of lighting commissioning devices.

Storing device control parameters for the first lighting device at the first lighting device 104 includes storing any device control parameters suitable for the lighting device. The device control parameters can be stored within the first lighting device or in external storage associated with the first lighting device. Examples of the device control parameters include binding information, group identification numbers, remote control identification numbers, dimming levels, dimming rates, and scene information, and the like. Those skilled in the art will appreciate that the particular device control parameters for a particular lighting device will depend on the type of lighting device and the use of the lighting device within the lighting system.

Determining the second lighting device location from the identification number for the second lighting device 106 can be performed using any one of the techniques applied in determining the location of a first lighting device from the identification number for that lighting device 102 as discussed above.

Transmitting the device control parameters from the first lighting device to the second lighting device 108 includes transmitting the device control parameters over the communications established among the lighting devices. In one embodiment, the transmitting the device control parameters includes executing a cloning program at the first lighting device. The cloning program can direct the lighting device to transmit the device control parameters to one or more other lighting devices, and control the manner of making the transmission.

Storing the device control parameters at the second lighting device 110 includes storing the device control parameters received from the first lighting device. The device control parameters can be stored within the second lighting device or in external storage associated with the second lighting device. In one embodiment, the method can continue with locating one or more additional lighting devices from their identification numbers, transmitting the device control parameters from the first or second lighting device to the additional lighting devices, and storing the device control parameters at the additional lighting devices. In one embodiment, the device control parameters are transmitted from one of the lighting devices and stored in another of the lighting devices one at a time. In another embodiment, the device control parameters are transmitted from one of the lighting devices and stored in a number of the lighting devices simultaneously, i.e., the transmission and storage is from a single lighting device to a group of lighting devices with known locations and identification numbers.

Figure 4:
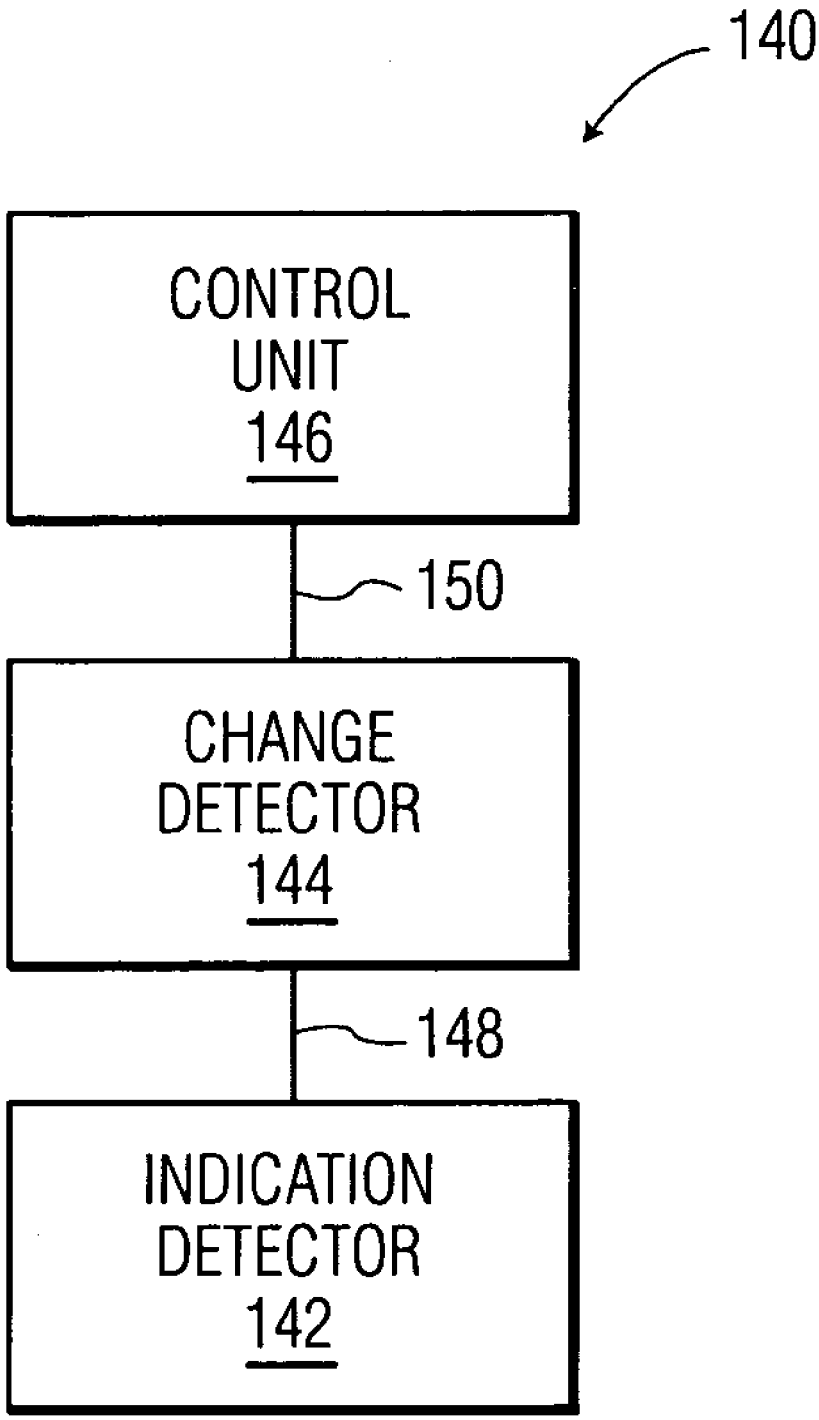
FIG. 4 is a block diagram of a lighting commissioning device made in accordance with the present invention.

FIG. 4 is a block diagram of a lighting commissioning device made in accordance with the present invention. The lighting commissioning device can be used as a communication gateway to the lighting system when commissioning the lighting system. The lighting commissioning device 140 for commissioning of a lighting device in a lighting system includes an indication detector 142 responsive to indication from the lighting device with the sensor generating a lighting device indication signal 148, a change detector 144 responsive to the lighting device indication signal 148 and generating an indication detected signal 150, and a control unit 146 receiving the indication detected signal 150 and being operably connected to the lighting system.

In operation, the lighting system directs the lighting device to be commissioned to provide an indication, such as a light, infrared light, sound, ultrasonic sound, radio frequency signal, or the like. For example, the lighting system can direct a lighting fixture having an identification number to turn on/turn off or dim up/dim down as an indication by sending an indicator command to the identification number. The indication detector 142 monitors the lighting device for the indication and generates a lighting device indication signal 148. The change detector 144 monitors the lighting device indication signal 148 for a change indicating that the lighting device has generated an indication and generates the indication detected signal 150 in response when a change is detected. The control unit 146 receives the indication detected signal 150, and can use the information to identify the location of the lighting device corresponding to the identification number. The control unit 146 can also direct the lighting system to transmit an indicator command to a number of lighting devices in the lighting system, to determine which of the lighting devices responds and provides an indication. In one embodiment, the control unit 146 and the other components of the lighting commissioning device 140 are incorporated in a single enclosure. In another embodiment, the control unit 146 is physically separate from the other components of the lighting commissioning device 140 and the indication detected signal 150 is transmitted wirelessly to the control unit 146. In yet another embodiment, the control unit 146 and other components of the lighting commissioning device 140 are in separate enclosures and the indication detected signal 150 is transmitted by wire to the control unit 146.

In one embodiment, the lighting commissioning device 140 is a portable device, such as a laptop computer, a handheld personal digital assistant (PDA), a pocket personal computer (PC), a portable dedicated lighting commissioning device, or the like. Examples of portable dedicated lighting commissioning devices include a pointing lighting commissioning device and a distributable lighting commissioning device. In another embodiment, the lighting commissioning device 140 is a part of the lighting system, such as a lighting system control. The lighting commissioning device 140 communicates with the lighting system over a wired or wireless communication path.

Figure 5:
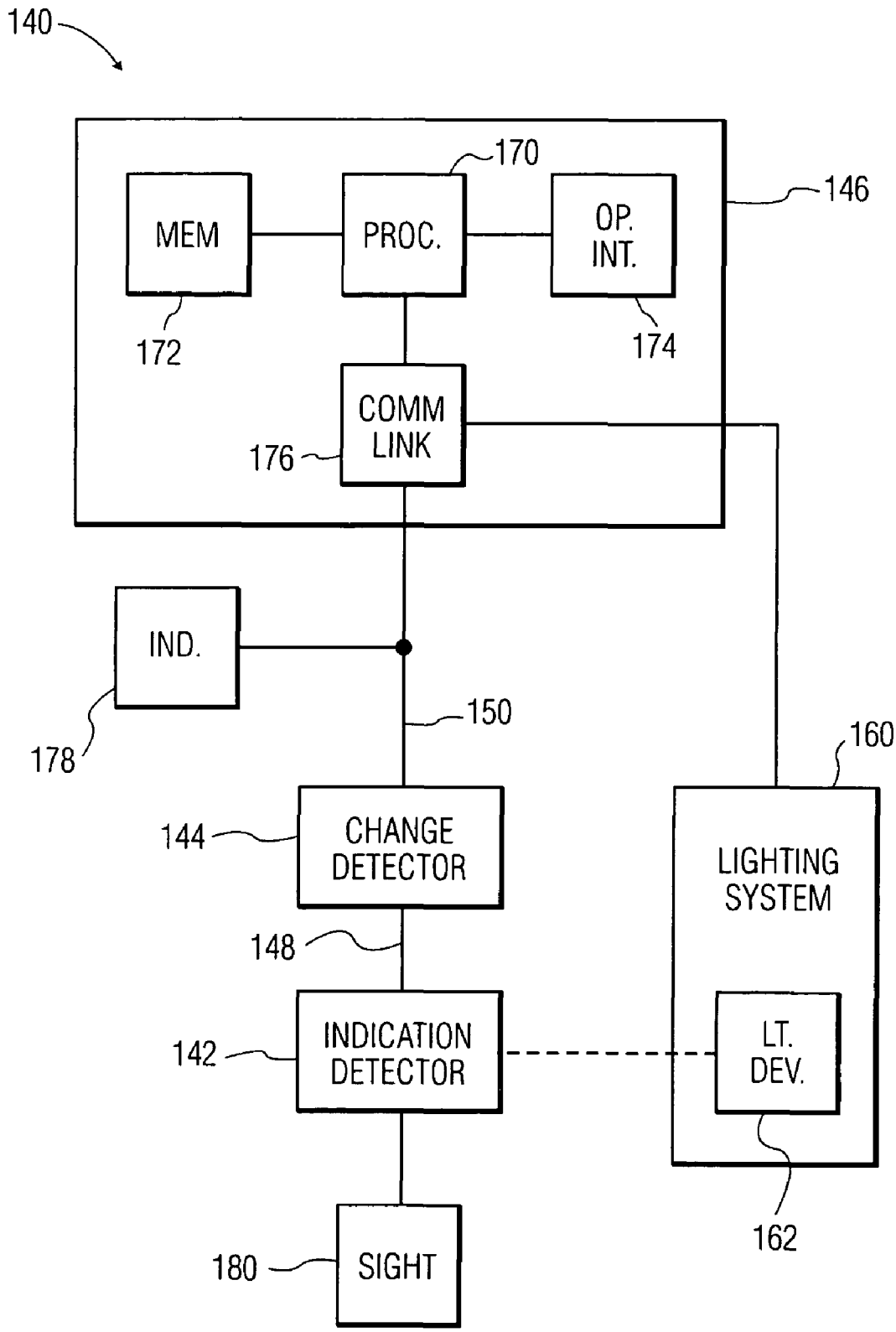
FIG. 5 is a block diagram of another embodiment of a lighting commissioning device made in accordance with the present invention.

FIG. 5, in which like elements share like reference numbers with FIG. 4, is a block diagram of another embodiment of a lighting commissioning device made in accordance with the present invention. In this example, the lighting commissioning device 140 is a pointing lighting commissioning device, which is pointed at a lighting device and detects an indication from the lighting device when the lighting device receives an indicator command directed to its identification number.

The lighting commissioning device 140 includes an indication detector 142, a change detector 144, and a control unit 146. The indication detector 142 monitors lighting device 162, which is included in lighting system 160. The lighting system 160 typically includes a number of lighting devices. The viewing angle of the indication detector 142 is any viewing angle suitable for viewing the lighting device being commissioned. Those skilled in the art will appreciate that the viewing angle of the indication detector 142 can be any angle suitable for the distance from the lighting device and the proximity of the lighting device under commissioning to other lighting devices. In one embodiment, the indication detector 142 is a narrow angle detector, with a viewing angle in the range of about 2 to 45 degrees, and typically in the range of about 5 to 15 degrees, so that the indication detector 142 focuses on a single lighting device. In another embodiment, the indication detector 142 is a variable angle detector, with the viewing angle of the indication detector 142 adjustable to provide the particular viewing angle desired for a particular application. The viewing angle can be adjusted with interchangeable masks with fixed apertures, an iris diaphragm, or the like. In one embodiment, the lighting commissioning device 140 includes a location detector to determine the location of the lighting commissioning device 140. The location detector can use any suitable method, such as GPS, triangulation, time-of-flight, or the like, applying internal and/or external signals to determine location. The location can be used to manually or automatically note the location of the lighting commissioning device 140 on a map of the area in which the lighting commissioning is being performed.

The control unit 146 communicates with the lighting system 160. The control unit 146 includes a processor 170 operably connected to a memory 172 for storing data and instructions and operably connected to an operator interface 174. The processor 170 is also operably connected to a communication link 176, which communicates with the change detector 144 and the lighting system 160. In one embodiment, the lighting commissioning device 140 is a portable device, such as a laptop computer, a handheld personal digital assistant (PDA), a pocket personal computer (PC), or the like, with the communication link 176 and/or the indication detector 142 plugging into available ports and/or slots in the computer. The operator interface 174 can be any type of interface suitable for interaction with the installer, such as a display, an LCD display, lights, keyboard, buttons, and the like. In one embodiment, the operator interface 174 includes a mapping interface to display the location of the lighting device in the building, floor, or other area.

The lighting commissioning device 140 can include additional components suited to a pointing lighting commissioning device as desired. In one embodiment, the lighting commissioning device 140 includes an optional tool indicator 178 responsive to the indication detected signal 150 to indicate when the indication is received from the lighting device 162. The tool indicator 178 can provide a visual or audible signal to the installer. In one embodiment, the lighting commissioning device 140 includes an optional sight 180 aligned with the indication detector 142 to direct the indication detector 142 to the lighting device 162. The sight 180 can be any sight capable of pointing the indication detector 142 to the lighting device 162, such as a laser pointer, laser sight, optical sight, bead sight, tube sight, or the like.

In operation, the installer establishes communications between a number of lighting devices, including a first lighting device having a first identification number, and determines a list of identification numbers for the lighting devices. In one embodiment, the list of identification numbers can be filtered when the list of identification numbers is determined. For example, when the list of identification numbers is determined by transmitting a signal and identifying which of the lighting devices respond, the list of identification numbers can be filtered by setting the strength of the transmitted signal at a predetermined value or screening the responses by signal strength. In another example, the initial list of identification numbers can be filtered by the type of lighting device and/or a particular range of identification numbers corresponding to lighting devices installed in a particular area.

The installer points the indication detector of the lighting commissioning device towards the first lighting device and initiates the lighting device indication, such as by pressing a Find ID button. With the indication detector trained on the first lighting device, the lighting system sequentially transmits an indicator command for each identification number on the list of identification numbers. When the indication detector detects an indication for the first lighting device, the control unit of the lighting commissioning device notes the location for the first lighting device. The indication can be discernable by the installer or can be so quick as to be humanly imperceptible. In one embodiment, the lighting commissioning device can beep or flash a tool indicator to alert the installer that the indication for the first lighting device has been received. In one embodiment, the lighting commissioning device can confirm the location for the first lighting device by directing the lighting system to transmit the indicator command to the same identification number which previously caused the indication for the first lighting device. In one embodiment, a map with the location of the lighting devices can be automatically updated with the location for the first lighting device. The device control parameters for the first lighting device can be stored at the first lighting device to complete the commissioning of the first lighting device.

Figure 6:
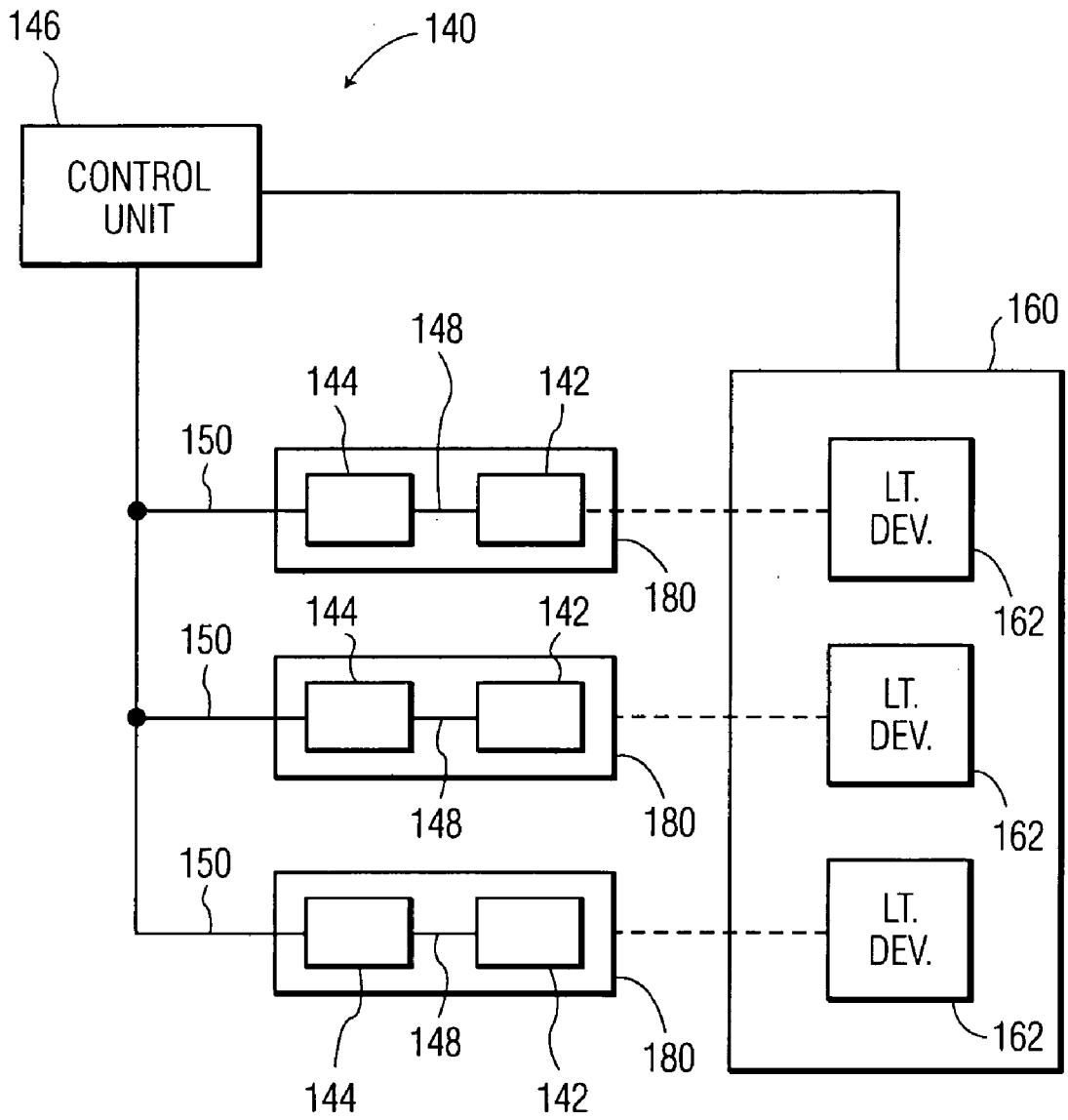
FIG. 6 is a block diagram of yet another embodiment of a lighting commissioning device made in accordance with the present invention.

FIG. 6, in which like elements share like reference numbers with FIGS. 4 & 5, is a block diagram of yet another embodiment of a lighting commissioning device made in accordance with the present invention. In this example, the lighting commissioning device 140 is a distributable lighting commissioning device, which can be distributed throughout a building, floor, or other area to locate lighting devices.

The lighting commissioning device 140 includes at least one control unit 146 and a number of portable units 180. The portable units 180 monitor a number of lighting devices 162 included in the lighting system 160. The portable units 180 include an indication detector 142 and a change detector 144. The viewing angle of the indication detector 142 is any viewing angle suitable for viewing the lighting devices being commissioned. Those skilled in the art will appreciate that the viewing angle of the indication detector 142 can be any angle suitable for the distance from the lighting device and the proximity of the lighting devices under commissioning. In one embodiment, the indication detector 142 is a wide angle detector, with a viewing angle in the range of about 45 to 180 degrees, so that placement of the portable units 180 relative to the lighting devices 162 is not critical. For example, one portable unit can be placed in each room of a building to monitor the lighting devices within each room. In another embodiment, the indication detector 142 is a variable angle detector, with the viewing angle of the indication detector 142 adjustable to provide the particular viewing angle desired for a particular application. The viewing angle can be adjusted with interchangeable masks with fixed apertures, an iris diaphragm, or the like. Each portable unit 180 has a lighting commissioning device identification number. In one embodiment, the portable units 180 include a location detector to determine the location of the portable units 180. The location detector can use any suitable method, such as GPS, triangulation, time-of-flight, or the like, applying internal and/or external signals to determine location. The location can be used to manually or automatically note the location of the portable units 180 on a map of the area in which the lighting commissioning is being performed.

The control unit 146 communicates with the portable units 180 and the lighting system 160. In one embodiment, the portable units 180 communicate with the control unit 146 through the lighting system 160. In one embodiment, the control unit 146 is a lighting system control normally used to control the lighting system 160 within a building. In one embodiment, a number of control units 146 are used.

In operation, the installer establishes communications between a number of lighting devices, including a first lighting device having a first identification number, and determines a list of identification numbers for the lighting devices. The installer distributing a plurality of the portable units of the lighting commissioning devices to desired locations, noting the location of each of the portable units, such as recording a lighting commissioning device identification number. The installer initiates the lighting device indication when conditions at the desired locations are suitable, such as at night when the lighting devices are light fixtures and the indication from the lighting devices is a change in light level. The lighting system sequentially transmits an indicator command for each identification number on the list of identification numbers and at least one of the lighting commissioning devices detects an indication for the first lighting device. The indication for the first lighting device can be correlated with the transmission of the indicator command for the first lighting device to determine the first lighting device location from location of the at least one of the plurality of lighting commissioning devices. In one embodiment, the indication detected signal provided to the control unit includes the lighting commissioning device identification number for the portable unit of the lighting commissioning device responding to the indication from the first lighting device. In another embodiment, the correlation between the indication for the first lighting device and the transmission of the indicator command for the first lighting device can be based on the time of each event at the control unit. The device control parameters for the first lighting device can be stored at the first lighting device to complete the commissioning of the first lighting device.

While the embodiments of the invention disclosed herein are presently considered to be preferred, various changes and modifications can be made without departing from the scope of the invention. The scope of the invention is indicated in the appended claims, and all changes that come within the meaning and range of equivalents are intended to be embraced therein.

The invention claimed is:

1. A lighting commissioning device for commissioning of a plurality of lighting devices in a lighting system, the lighting commissioning device comprising:

an indication detector responsive to indication from the lighting device and generating a lighting device indication signal;

a change detector responsive to the lighting device indication signal and generating an indication detected signal;

a control unit receiving the indication detected signal and being operably connected to the lighting system;

means for determining a list of identification numbers for the plurality of lighting devices, wherein said control unit is operable to sequentially transmit an indicator command for each identification number on the list of identification numbers; and a location detector to determine location of the lighting commissioning device.

2. The device of claim 1 wherein the indication is selected from the group consisting of light, infrared light, sound, ultrasonic sound, and radio frequency signal.

3. The device of claim 1 further comprising a mapping interface to display location of the lighting device.

4. The device of claim 1 wherein the indication detector is a narrow angle detector.

5. The device of claim 4 further comprising a sight to direct the indication detector to the lighting device.

6. The device of claim 1 further comprising a tool indicator responsive to the indication detected signal to indicate when the indication is received from the lighting device.

7. The device of claim 1 wherein the lighting commissioning device has a lighting commissioning device identification number, and the indication detected signal includes the lighting commissioning device identification number.

8. The device of claim 1 wherein the indication detector is a wide angle detector.

9. The device of claim 1 wherein the indication detector is a variable angle detector.

10. A lighting commissioning device for commissioning of a plurality of lighting devices in a lighting system, the lighting commissioning device comprising:

means for establishing communications between a plurality of lighting devices including a first lighting device having a first identification number, means for determining a list of identification numbers for the plurality of lighting devices, means for sequentially transmitting an indicator command for each identification number on the list of identification numbers, a change detector operable to detect an indication for the first lighting device and generating an indication detected signal;

a location detector to determine the location of the lighting commissioning device; and a control unit for correlating the indication detected signal for the first lighting device with transmission of the indicator command for the first lighting device to determine the first lighting device location from said determined location of said lighting commissioning device.

* * * * *